US006062242A

United States Patent [19]

Lin

[11] Patent Number: 6,062,242

[45] Date of Patent: May 16, 2000

[54] UMBRELLA FRAME

[75] Inventor: Yao-Chin Lin, Tainan, Taiwan

[73] Assignee: Asia Umbrella Industries Co., Ltd., Taiwan

[21] Appl. No.: 09/151,192

[22] Filed: Sep. 10, 1998

[30] Foreign Application Priority Data

Aug. 11, 1998 [TW] Taiwan ..... 87213065

[51] Int. Cl.[7] ..... A45B 19/10

[52] U.S. Cl. ..... 135/31

[58] Field of Search ..... 135/15.1, 20.3, 135/27, 28, 29, 31, 32

[56] References Cited

U.S. PATENT DOCUMENTS 5,553,634 9/1996 Yang ..... 135/25.3

5,931,175 8/1999 Lin ..... 135/31

*Primary Examiner*—Beth A. Aubrey

*Attorney, Agent, or Firm*—Jackson Walker L.L.P.

[57] ABSTRACT

An improved umbrella frame comprises a stick having an upper sleeve which has an upper nest set on the topside thereof being installed on the stick. And below the upper sleeve, the stick is further installed a mid runner and a lower runner between which a spring is set. A pluralities of long ribs are radiated around the nest and each of which have a first end pivotally connected thereto. A plurality of short ribs are radiated around the mid runner and each of which have a firs end pivotally connected thereto, and a second end pivotally connected to the long ribs. Wherein, the short ribs are made of fiber material and are formed in a solid rectangular shape with the lateral edge being longer than the top and bottom edge.

3 Claims, 6 Drawing Sheets

UMBRELLA FRAME

BACKGROUND OF THE INVENTION

1. Field of the Invention

The present invention relates to an improved umbrella frame, which has an improved longitudinal supporting strength, and, in particular, has a lateral elastic property, so as to prevent the short ribs of the frame from breaking.

2. Description of Related Art

Normally, an umbrella of the related art is a light screen of silk, cotton, or other fabric, stretched on a folding frame with radiating ribs on a stick for holding above the head of a user as a protection against the rain or the sun. As shown in FIGS. 6 and 7, the frame of an umbrella having a stick (50) includes an upper sleeve (56) with a nest (57) set on the top end thereof, a mid runner(54), and a lower runner (51) being installed beneath the upper sleeve (56). A plurality of long ribs (58) are radiated around and pivotally connected with the nest (57). A plurality of U shaped metal-made short ribs (55) are radiated around the mid runner (54) and each of which are pivotally connected between the mid runner (54) and the long ribs (58). A plurality of stretchers (52) are radiated around the lower runner (51) and each of which are pivotally connected between the lower runner (51) and one of the short ribs (55). Thus, by pushing the lower runner (51) upwards, the stretchers (52) and the short ribs (55) are accordingly being pushed, and therefore, the short ribs (55) will be stretched outward along with the long ribs (58).

Structurally, the outward stretching of the long ribs (58) is supported by the short ribs (55) on an appropriate position of the long ribs (58), and the short ribs (55) are supported by the restoring force of a spring (53) which is installed between the lower runner (51) and the mid runner (54). However, the most breakage in the use of such an umbrella is the break of the U-shaped metal-made short ribs (55). Although the structure of the short ribs (55) is strong enough to support the stretched long ribs (58), its lateral strength is not as strong as the longitudinal strength such that it is easy to be deformed subject to the side impact.

SUMMARY OP THE INVENTION

The main object of the present invention is to provided an improved umbrella frame comprising a handle, a stick with a cap set on the top end thereof, an upper sleeve which has an upper nest being installed on the stick below the cap, a mid and a lower runners set beneath the upper sleeve and a spring installed between the mid and lower runners. A plurality of long ribs each have one end pivotally connected to the upper nest. And a plurality of short ribs each having a first end pivotally connected to the mid runner and a second end pivotally connected to one of the long ribs. Particularly, the short ribs are made of fiber material, carbon fiber or glass fiber, and are made in a solid rectangular shape which has the lateral edges being longer then the top and bottom edges. In this way, the short ribs provides an improved longitudinal supporting strength and a lateral resilience to prevent the short ribs from breaking when a side impact acts thereon.

DETAILED DESCRIPTION OF PREFERRED EMBODIMENT

Figure 1:
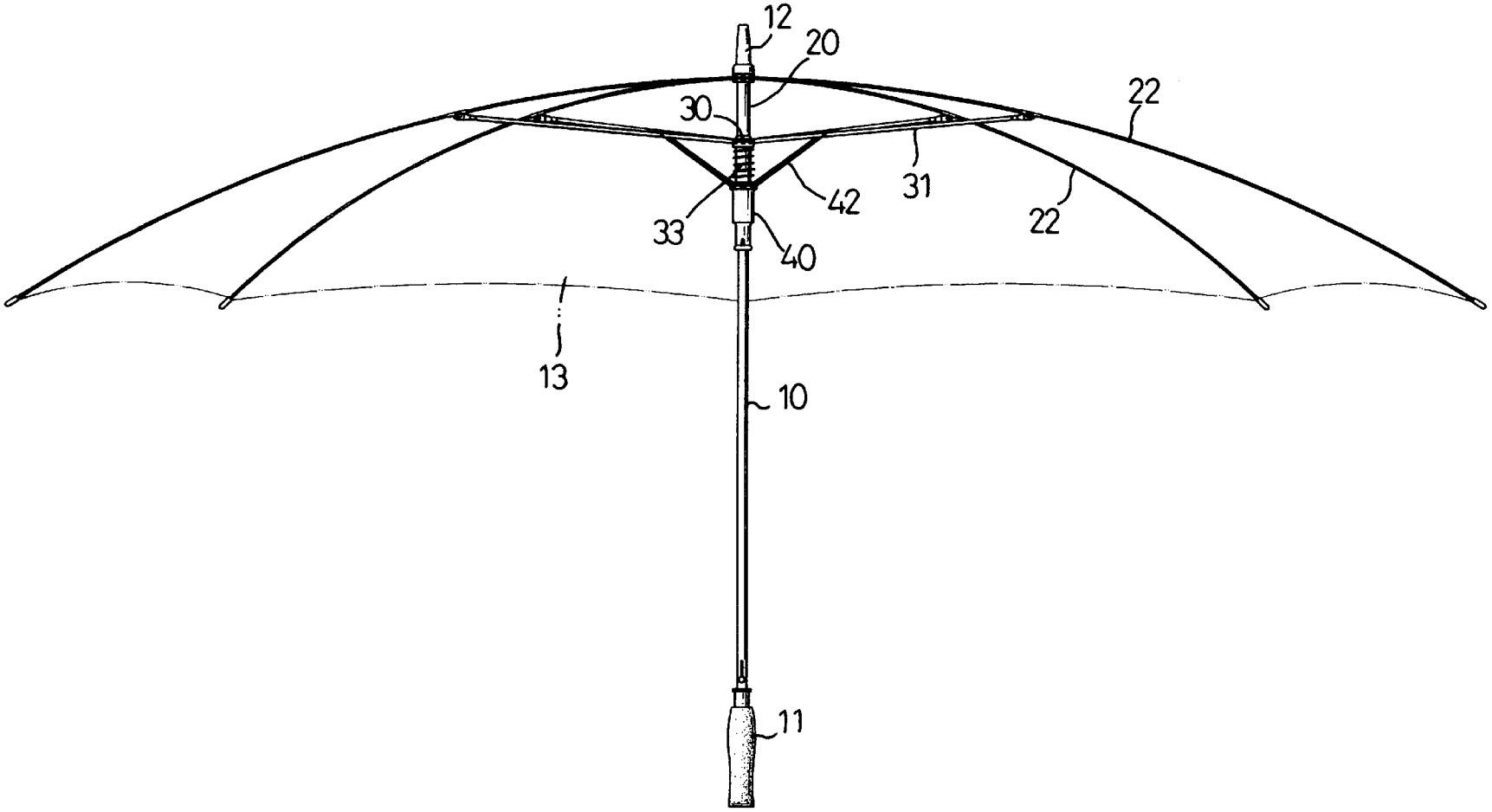
FIG. 1 is a schematic view showing the umbrella of the present invention in its stretched status.
Figure 2:
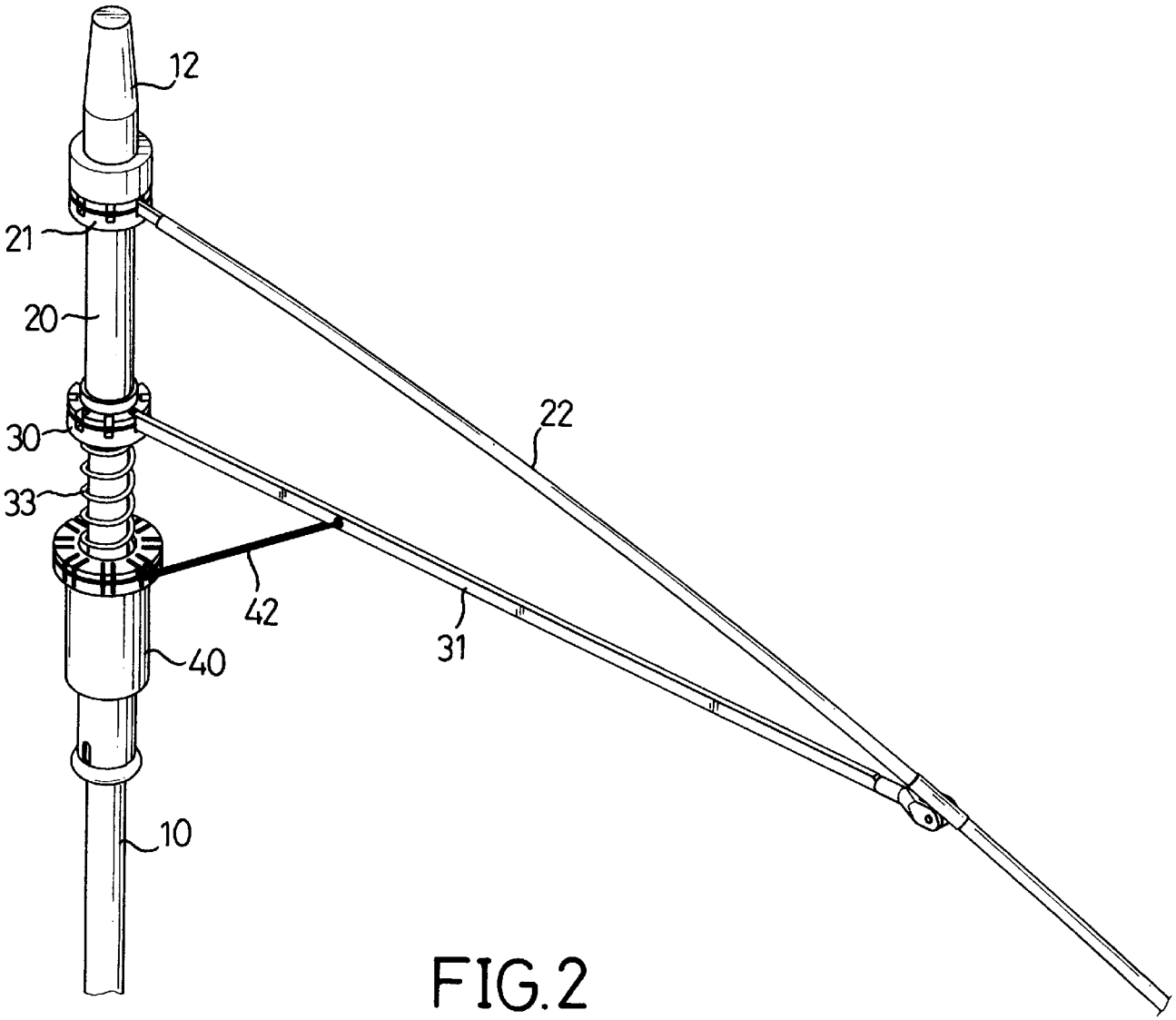
FIG. 2 is a perspective view of a part of the umbrella frame of the present invention.

FIG. 1 shows the stretched status of an umbrella of the present invention. A handle (11) is installed on the bottom end of a stick (10), and a cap (12) is installed on the top end of the stick (10). As shown in FIG. 2, an upper sleeve (20) which has an upper nest set on the top end thereof is installed on the stick (10) beneath the cap (12). Beneath the upper sleeve (20), the stick (10) is installed by a mid runner (30) and a lower runner (40), between which a spring (33) is installed. A plurality of long ribs (22) are radiated around the upper nest of the upper sleeve (20) which the long ribs (22) each have one end being connected thereto. And a plurality of the short ribs (31) are radiated around the mid runner (30) which the short ribs each have one end being pivotally connected thereto, and each have another end being pivotally connected to the respective long rib.

Figure 3:
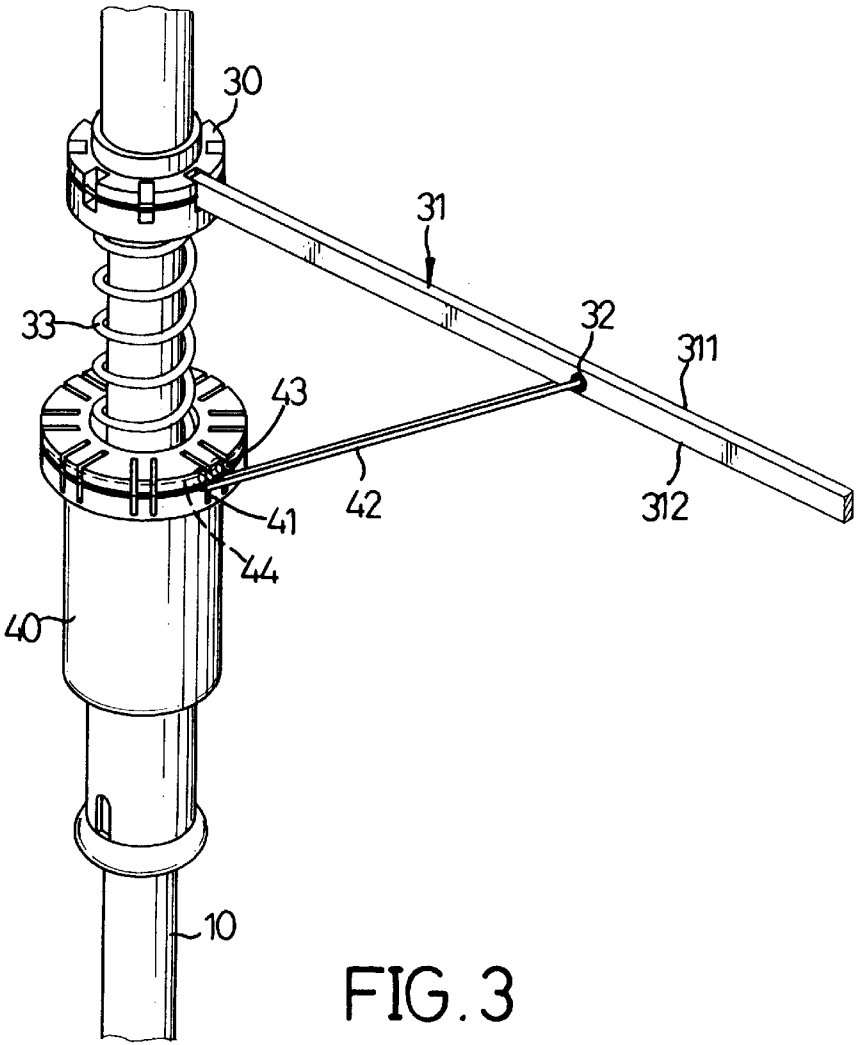
FIG. 3 is a perspective view of the part of the umbrella frame of the present invention.
Figure 4:
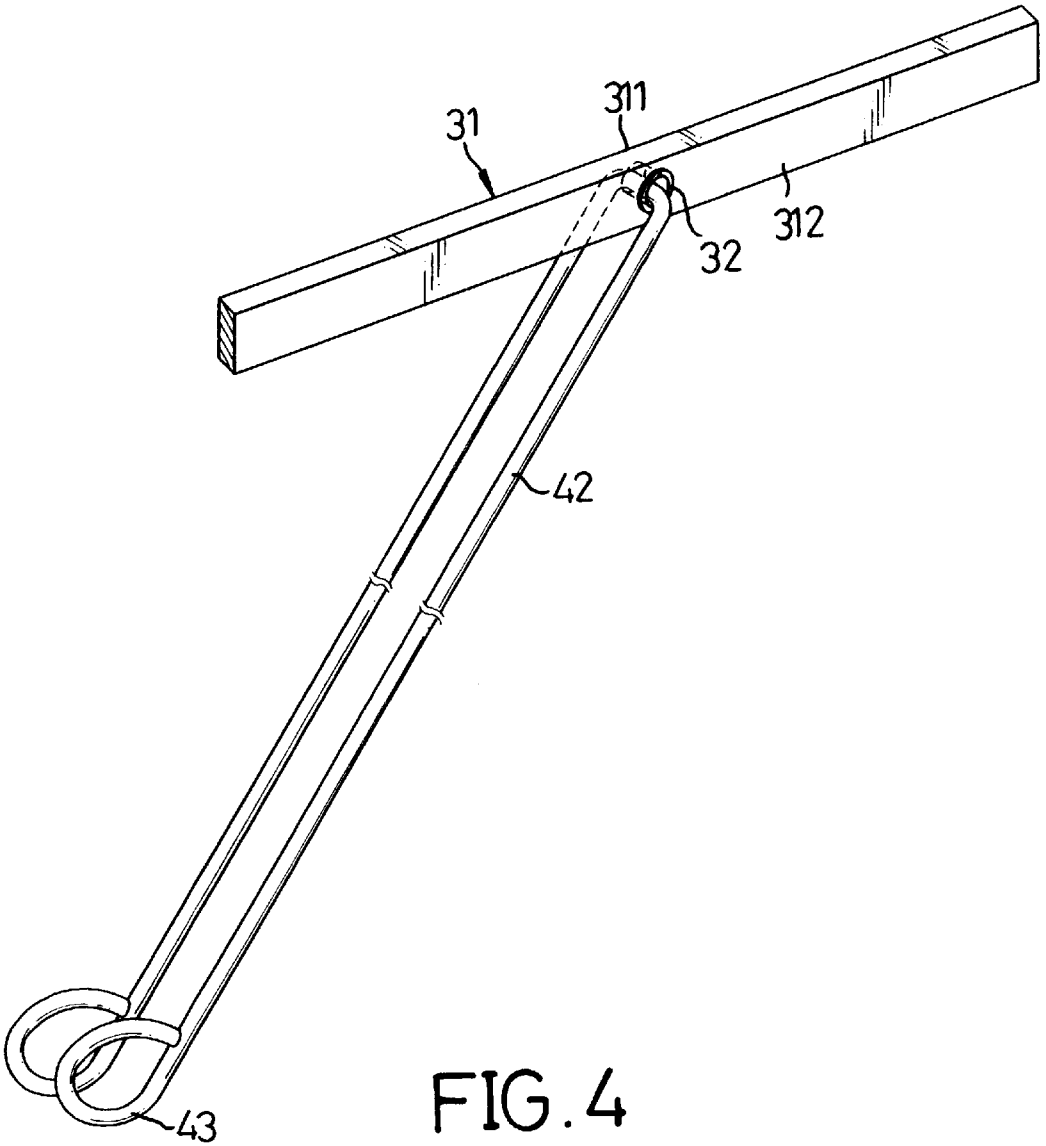
FIG. 4 is a perspective view of the combination of the short rib and the stretcher of the umbrella frame of the present invention.

As shown in FIGS. 3 and 4, a pivot hole (32), which could be riveted by a metal sleeve, is defined in an appropriate position of the short rib (31). A stretcher (42) has one end inserted through the pivot hole (32) and then two ends of which are bent over to form a hook (43). Then the hooks (43) of the stretchers (42) are placed into a plurality of flutes (41) of the lower runner (40), and be fixed by a wire ring (44). Thus, by pushing the lower runner (40) upwards, the stretchers (42) will support the short ribs (31) to stretch upward to support the long ribs(22). And the screen is stretched on the long ribs (22).

The present invention is characterized that the short ribs (31) are made of fiber material, carbon fiber or glass fiber, and are made solid rectangular shape with the lateral edges (312) being longer than the top and bottom edges (311). The fiber material has a rustless feature, and the solid rectangular shape of the short ribs (31) has good mechanical property that the top and bottom short edges (311) provide strength enough for supporting the long rib (22). And moreover, while a side force acts on the lateral long edge (312), the fiber material will prevent the short ribs (31) from breaking by its elastic property, which is to provide a buffering.

Figure 5:
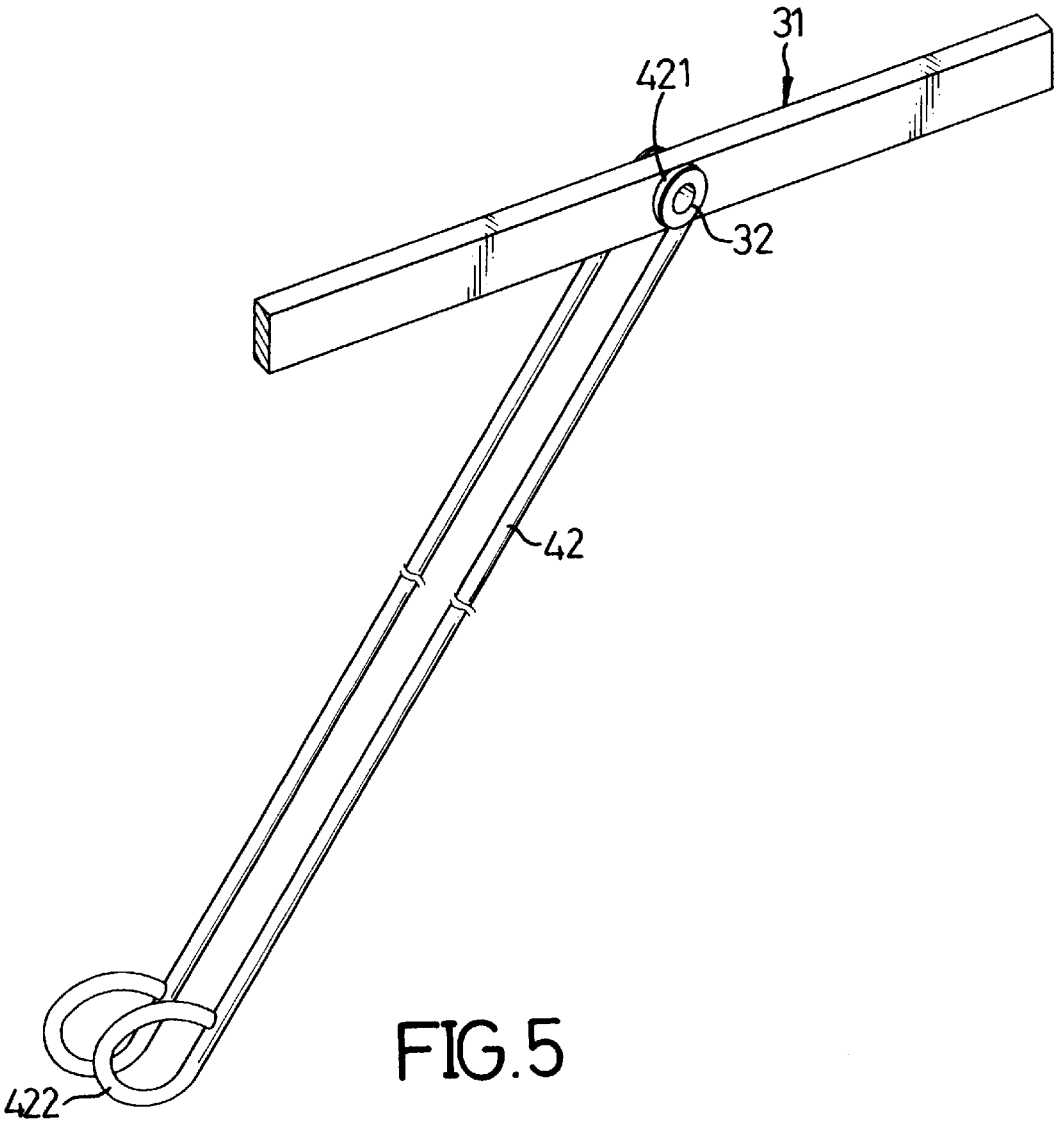
FIG. 5 is a schematic view showing another combination of the short rib and the stretcher of the umbrella frame of the present invention.
Figures 6, 7:
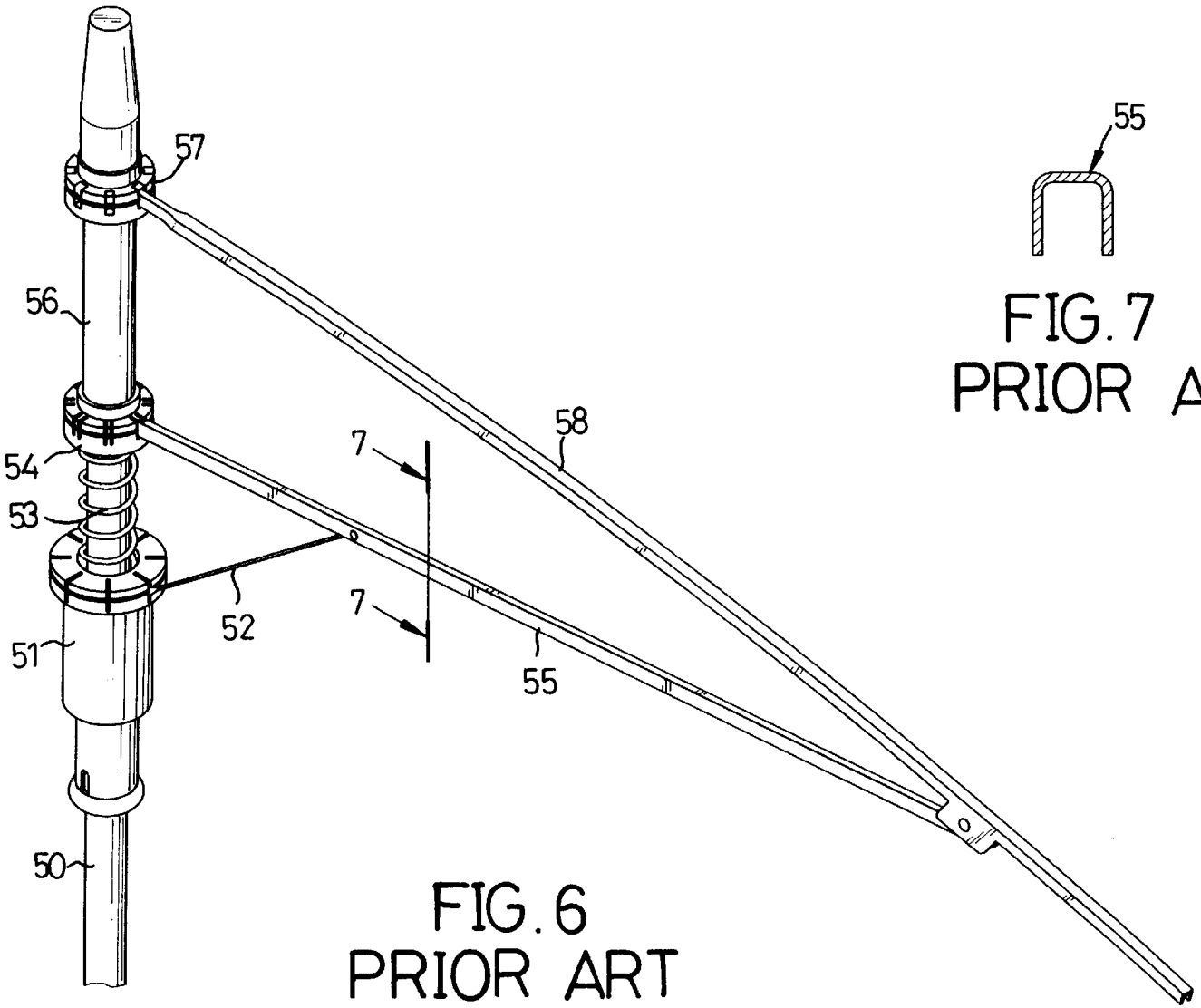
FIG. 7 PRIOR ART
FIG. 6 PRIOR ART
FIG. 6 is the perspective view of a conventional umbrella frame.
FIG. 7 shows the sectional view of the short rib shown in FIG. 6.

Furthermore, FIG. 5 shows another installation embodiment of the present invention, wherein the stretcher (42) forms two upper O ring (421) on the top end and two lower O ring (422) on the bottom end. The upper O rings (421) are riveted on lateral faces of the short rib (31) together with the pivot sleeve (32), which can still fulfill the satisfaction of users.

What is claimed is:

1. An improved umbrella frame comprising a stick having a handle installed on a bottom end thereof, a cap set on a top end thereof, an upper sleeve which has an upper nest on a topside thereof and installed on the stick beneath the cap, a mid runner and a lower runner installed on the stick beneath the upper sleeve and a spring installed between the mid and lower runners, a plurality of long ribs which are radiated around the upper nest and one end of which is pivotally connected thereto, a plurality of short ribs which are radiated around the mid runner and have a first end pivotally connected thereto, and a second end pivotally connected to the long ribs, a plurality of stretchers radiated around the lower runner and each have a first end pivotally connected thereto, and a second end pivotally connected to one of the short ribs, wherein the improvement comprising:

the short ribs are made of fiber material and are formed in a solid rectangular shape with two lateral edges each with a height greater than a width of a top and a bottom edge, wherein a pivot hole is defined on the short rib with a sleeve riveted therethrough for pivotally jointing with the stretcher.

2. An improved umbrella frame as claimed in claim 1, wherein the sleeves riveted through the short ribs are made of copper, and the stretchers are put through the pivot hole and pivotally connected to the short ribs.

3. An improved umbrella frame as claimed in claim 1, wherein each end of the stretcher forms two lower hooks, and two upper hooks which are pivotally connected to the short ribs together with a rivet nut being riveted on the lateral edges of the short ribs.

* * * * *